US006287174B1

(12) United States Patent
Detzel et al.

(10) Patent No.: US 6,287,174 B1
(45) Date of Patent: Sep. 11, 2001

(54) POLISHING PAD AND METHOD OF USE THEREOF

(75) Inventors: Thomas Detzel, Villach (AU); Uwe Weickert, Heimstetten (DE)

(73) Assignee: Rodel Holdings Inc., Wilmington, DE (US)

( * ) Notice: Subject to any disclaimer, the term of this patent is extended or adjusted under 35 U.S.C. 154(b) by 0 days.

(21) Appl. No.: 09/497,416

(22) Filed: Feb. 4, 2000

Related U.S. Application Data

(60) Provisional application No. 60/118,900, filed on Feb. 5, 1999, and provisional application No. 60/133,431, filed on May 11, 1999.

(51) Int. Cl.[7] ..... B24B 1/00

(52) U.S. Cl. ..... 451/41; 451/41; 451/285; 451/287; 451/288; 451/289

(58) Field of Search ..... 451/41, 285, 287, 451/288, 289

(56) References Cited

U.S. PATENT DOCUMENTS 5,658,190 8/1997 Wright et al. .
5,842,910 12/1998 Krywanczyk et al. .
5,882,248 * 3/1999 Wright et al. ..... 451/285
6,203,407 * 3/2001 Robinson ..... 451/41

FOREIGN PATENT DOCUMENTS 0 806 267 A1 11/1997 (EP) .

* cited by examiner

*Primary Examiner*—Derris H. Banks
*Assistant Examiner*—Shantese McDonald
(74) *Attorney, Agent, or Firm*—Kenneth A. Benson; Konrad Kaeding

(57) ABSTRACT

A polishing pad for semiconductor wafers having a polishing surface surrounding at least one wafer non-contact region and a method for disengaging a wafer with the polishing pad is disclosed. The wafer non-contact region(s) are located and dimensioned to provide a location for positioning the wafer prior to disengagement, thereby reducing the cohesion force of the slurry resisting the force used for lifting the wafer from the plane of the polishing pad surface. The invention provides safe disengagement of the wafer with the polishing pad, and is especially useful for polishing apparatus employing vacuum retaining means for holding the wafer.

10 Claims, 1 Drawing Sheet

POLISHING PAD AND METHOD OF USE THEREOF

This application claims the benefit of Provisional Application No. 60/118,900 filed Feb. 5, 1999 and Provisional Application No. 60/133,431 filed May 11, 1999.

BACKGROUND OF THE INVENTION

1. Field of the Invention

The present invention relates to the polishing of silicon wafers, semiconductor wafers, and integrated circuit wafers, and more particularly to an improved polishing pad and a method for disengaging a microelectronic substrate such as a silicon wafer and a semiconductor wafer from a polishing pad.

2. Description of Related Art

In the manufacture of integrated circuit and semiconductor devices fine polishing is used to provide a planarized surface, which is necessary to obtain before the addition of another layer of material. For instance without fine polishing, metallization layers (formed to provide interconnects between various devices) tend to create nonuniform surfaces, and these surface nonuniformities may interfere with the optical resolution of subsequent lithographic steps, thereby leading to difficulty with printing high resolution patterns. The surface nonuniformities may also interfere with step coverage of subsequently deposited metal layers and possibly cause open or shorted circuits.

Various techniques have been developed to planarize one or more layers of a semiconductor device. One such approach involves polishing a layer with a polishing slurry that includes abrasive particles mixed in an aqueous medium. Typically with this approach: i. a wafer is mounted in a wafer holder; ii. a polishing pad's polishing surface is substantially saturated with an appropriate slurry, iii. the pad and the wafer are moved relative to one another such that the wafer provides a planer motion with respect to the pad, and iv. the polishing surface of the pad and the substrate to be polished are biased toward one another. Ideally, the polishing operation erodes surface protrusions ("peaks") to a much greater extent than surface indentations ("valleys"), and the process continues until the substrate is largely flattened. In one embodiment, slurry is introduced near the center of the pad, then forms a ring on top of the substrate and then the slurry exits the process as new slurry is introduced. It is generally desirable to maintain an adequate amount of slurry between the wafer and the pad, while dispensing as little slurry as possible to lower costs.

The polishing pads used in semiconductor device and/or memory disk manufacture will be referred to in this specification as "chemical mechanical polishing" or "CMP" pads, because they provide polishing by means of chemical and mechanical interaction (as opposed to micros-grinding). CMP pads will generally have a texture which allows slurry to move within the polishing interface. CMP polishing pads with various topographies that improve the polishing operation are known in the art.

Generally speaking, prior to disengaging a substrate from a CMP polishing pad, the contact region between slurry and substrate is substantial, owing to: i. the reservoir of slurry retained in the CMP pad void pattern, and ii. the likelihood that an area of the pad surface defines an enclosed void having no portion open to the atmosphere to break a vacuum created during the disengaging of the pad from the substrate. The resulting cohesive force due to surface tension of the fluid can be substantial and can give rise to problems during disengagement of the pad and the substrate.

In the electronic's industry, typical substrate-holding devices employ a vacuum in a chuck assembly, and this device is generally used to retain the substrate during polishing. A recurring problem can be encountered when disengaging a vacuum-held substrate from the polishing pad. The cohesive force within the slurry from contact of the slurry with a substantial portion or entire surface of the substrate can exceed the force provided by the vacuum retaining means on the chuck. The substrate can be dislodged from the chuck upon attempting disengagement with the pad, leading to risk of damage to the substrate. Accordingly, a need exists for a polishing pad that provides reduced cohesive force from contact of the slurry during wafer disengagement, and a method is needed for disengaging a substrate from a CMP polishing pad which provides a limited cohesive force opposing the wafer-holding means at the location where the wafer and pad are disengaged.

One solution to the disengagement problem is shown in U.S. Pat. No. 5,658,190 and No. 5,882,248 wherein, at the outer edge of a circular pad, the edge of the substrate wafer is forced up an incline so that the vacuum underneath the wafer is broken. This method is not desirable because the wafer and its carrier are forced out of the parallel position with regard to the pad.

It is known that such very high cohesive force between a wafer and a grooved polishing pad are not encountered. Grooved pads described in European Patent Application No. EP 0 806 267 A1 state that "The plurality of grooves in the polishing pad surface also result in a minimal surface tension build up between the polishing pad and the substrate to facilitate separation between the two." U.S. Pat. No. 5,842,910 describes polishing pads with non-concentric grooves and states that such pads "eliminates a phenomena called 'wafer stickage' where cohesive forces between the face of the wafer and the actual smooth polishing pad form a suction. When suction is created it is very difficult to pull the wafer off the face. So by having grooved rings it provides a release so that the wafer can actully lift back off the polishing surface.

It would be most advantageous to have a polishing pad which is uniformly flat over the surface used for polishing, but wherein a portion of the surface which is not used for polishing is available for use when it is necessary to disengage the wafer from the pad.

SUMMARY OF THE INVENTION

The present invention provides an improved CMP polishing pad and a method of disengaging a substrate from such pads. The GMP polishing pads of the present invention include a polishing surface having a "release enhancing" region. This release-enhancing region is dimensioned to provide release when the pad and substrate are separated.

In one embodiment, this release-enhancing region of the pad is near the center of the pad. Whether symmetrical or not however, the release enhancing region is generally in a region that is not used for the polishing operation. It is preferred that the substrate not move across or over the release enhancing region during polishing. The polishing region of the pad has a uniform surface that is not embossed so that it has a flat uniform surface for polishing. There are many polishing operations for which grooved pads do not provide desirable polishing.

Accordingly, an object of the invention is to provide a polishing pad which provides a reduced release resistance and thereby facilitates the disengagement of the wafer and the polishing pad. The release enhancing portion of the pad is an indentation, groove, crease, hole or other configuration.

The invention also includes a method of disengaging a semiconductor wafer or memory disk substrate from a polishing pad, comprising the steps of: i. providing a polishing pad in combination with a slurry; ii. contacting the combination with the substrate; iii. after polishing the substrate, sliding substrate across the pad until at least a portion of the substrate is facing the release enhancing portion of the pad; and iv. thereafter pulling the substrate away from the pad. In accordance with the present invention, the pad is generally released from the substrate by moving the pad and substrate away from one another in two planes which are substantially parallel to one another until at least a portion of the substrate is facing a least a portion of the release enhancing area, and the pad and substrate are then pulled apart.

These and other objects, features and advantages of the invention will be further described and more readily apparent from a review of the detailed description of the preferred embodiments which follow.

BRIEF DESCRIPTION OF THE DRAWINGS

The following detailed description of the preferred embodiments can best be understood when read in conjunction with the following drawings, in which.

DETAILED DESCRIPTION OF THE PREFERRED EMBODIMENTS

Figure 1:
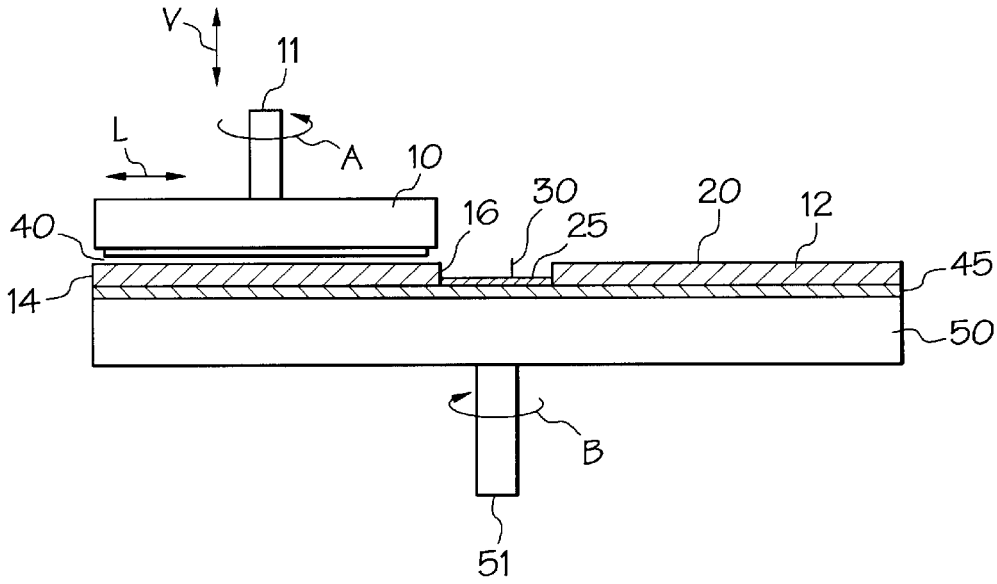
FIG. 1 shows a cross-sectional schematic view of a wafer engaged in a chuck and a polishing pad on a platen wherein the wafer surface is over the annular polishing area of a pad of the present invention.

In the drawings, depicted elements are not necessarily drawn to scale and like or similar elements may be designated by the same reference numeral throughout the several views.

Figure 2:
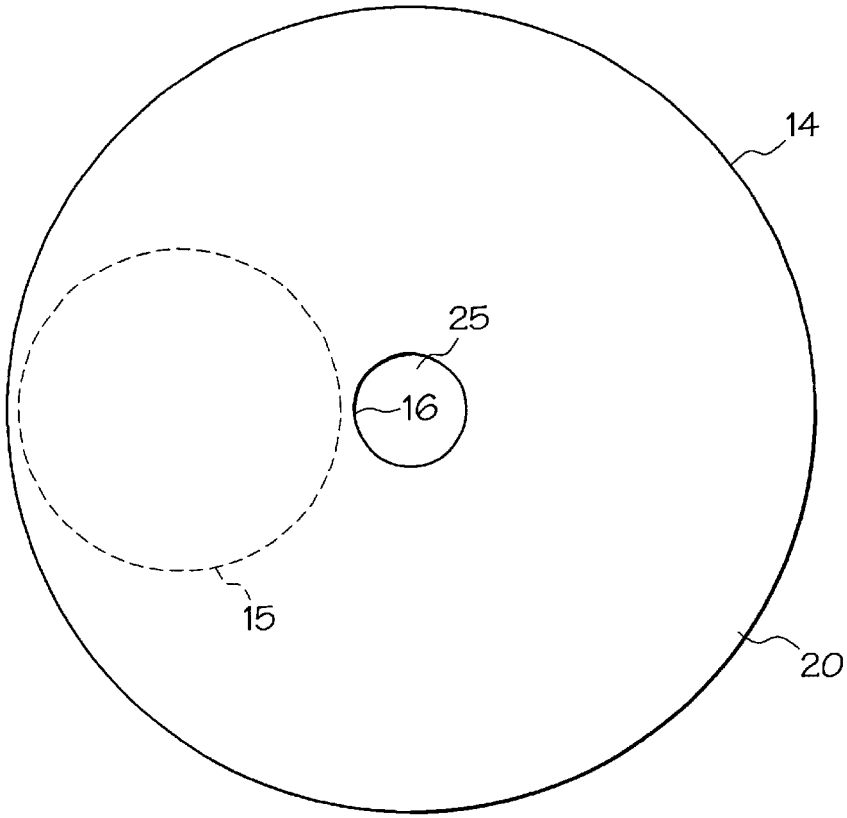
FIG. 2 shows a top plan view of the polishing pad of the present invention shown in FIG. 1.

FIG. 1 shows a cross sectional view of a polishing assembly including platen 50, a pressure sensitive adhesive (PSA) film layer 45 engaged between platen 50 and pad 12 according to an embodiment of the present invention. The assembly depicted in FIG. 1 includes a wafer chuck 10 engaged to a wafer 40. Wafer 40 is contacting the planar polishing surface 20 of polishing pad 12. Pad 12 in FIG. 1 includes an outer circumferential edge 14 and an inner circumferential edge 16. Inner circumferential edge 16 forms the boundary of the non-contacting region 30. In FIG. 1, PSA layer 45 is covered by a film 25 adhered thereto. When the wafer is to be removed from the pad surface, it is first moved over the non-contact region 30. By passing over the non-contact region enough of the cohesive force between the pad and the wafer is eliminated that the wafer can be easily disengaged from the surface of the pad. FIG. 2 shows the relative size of a pad annular contact area and a circular release area which works well for an 8-inch diameter wafer (the outline of which is shown as 15). The pad is a 20-inch diameter pad with a 3-inch diameter hole or depression (release area) in the middle of the pad. This leaves an 8 and ½ inch wide annular section for polishing. When the wafer is to be removed from contact with the pad, it is brought to a position at least partially over the hole or depression. Removal is then possible.

An alternate embodiment using a wafer and a pad of the same dimensions is to provide a 3-inch diameter circular groove in the center of the pad. A groove of about ⅛ inch width will provide for release of an 8 inch diameter wafer.

The polishing pads of the present invention can be fabricated using conventional pad-forming equipment. As one approach, hot liquidous polyurethane is poured into a large cylindrical form to create a cake, the cake is cured, individual pads are sliced off the cake using a skiver, and the non-contact region(s) are formed by machining the pads using a mill or a lathe. They may also be cut from the pad with a die. As another approach, the chemicals that form a polyurethane polishing pad are introduced into a stainless steel mold, a polyurethane sheet is formed with a topography that is an inverse image of the mold surfaces, and the polyurethane sheet is removed from the mold.

The most preferred pad comprises a polishing layer having the following properties:

i. a density greater than 0.5 g/cm$^3$;

ii. a critical surface tension greater than or equal to 34 milliNewtons per meter;

iii. a tensile modulus of 0.02 to 5 GigaPascals;

iv. a ratio of tensile modulus at 30° C. to tensile modulus at 60° C. of 1.0 to 2.5;

v. a hardness of 25 to 80 Shore D;

vi. a yield stress of 300–6000 psi;

vii. a tensile strength of 1000 to 15,000 psi; and viii. an elongation to break less than or equal to 500%, said matrix material comprising at least one moiety from the group consisting of: 1. a urethane; 2. a carbonate; 3. an amide; 4. an ester; 5. an ether; 6. an acrylate; 7. a methacrylate; 8. an acrylic acid; 9. a methacrylic acid; 10. a sulphone; 11. an acrylamide; 12. a halide; 13. an imide; 14. a carboxyl; 15. a carbonyl; 16. an amino; 17. an aldehydric; 18. a urea; and 19. a hydroxyl.

Referring back to FIG. 1 which shows a cross-sectional view of polishing assembly for polishing a semiconductor wafer in accordance with an embodiment of the present invention. The polishing assembly includes polishing pad 12 removably secured to rotatable platen 50. Wafer 40 has its backside (opposite the side to be polished) removably secured, such as by vacuum suction, to a wafer holder shown as chuck 10. A chuck spindle is fixed to the top of chuck 10. The wafer holder assembly is movable both laterally (direction L) and vertically (direction V)

A preferred operation of the polishing apparatus is now described. Initially, the chuck spindle rotates chuck 10 and wafer 40 in clockwise direction A. Platen spindle 51 rotates platen 50 and pad 12 in counterclockwise direction B, polishing arm 11 holds wafer 40 outside of the non-contact region 30 while a dispenser (not depicted) dispenses slurry onto polishing surface 20. After contacting polishing surface 20, the slurry flows centrifugally toward outer circumferential edge 14 and is slung off the pad. The wafer holding assembly is actuated downward so that wafer 12 is pressed against polishing surface 20 and continues to exert a downward pressure to enable pad 12 and the slurry to polish wafer 40. Excess slurry and removed materials exit through a drain. Periodically, an operator can retract the wafer holding assembly vertically to observe the progress of polishing. The location of wafer 40 is programmed to be positioned over a sufficient amount of the non-contact area prior to lifting the wafer from the pad.

Other variations and modifications of the embodiments disclosed herein may be made based on the description set forth herein, without departing from the scope and spirit of the invention as set forth in the following claims.

What is claimed is:

1. A process for polishing a semiconductor or memory disk substrate, comprising:

providing a polishing pad having a polishing surface and a recessed region, polishing said substrate while said substrate is in contact with only said polishing surface, after polishing is completed, positioning at least a portion of said substrate over said recessed region, and disengaging said substrate from the planar surface of said polishing pad.

2. The process of claim 1 wherein said recessed region is in the center of said pad.

3. The process of claim 2 wherein said recessed region is a circular resessed region.

4. The process of claim 1 wherein said recessed region has a depth substantially the same as the thickness of said polishing pad, and wherein said recessed region is covered by a film.

5. The process of claim 4 wherein said recessed region is in the center of said pad.

6. The process of claim 5 wherein said recessed region is a circular resessed region.

7. The process of claim 1 wherein said recessed region is a groove.

8. The process of claim 7 wherein said recessed region is a circular groove in the center of said pad.

9. The process of claim 1, wherein said substrate is held in a chuck by means of a vacuum applied thereto.

10. The process of claim 1 wherein said pad comprises a polishing layer having the following properties:

i. a density greater than 0.5 g/cm$^3$;

ii. a critical surface tension greater than or equal to 34 milliNewtons per meter;

iii. a tensile modulus of 0.02 to 5 GigaPascals;

iv. a ratio of tensile modulus at 30° C. to tensile modulus at 60° C. of 1.0 to 2.5;

v. a hardness of 25 to 80 Shore D;

vi. a yield stress of 300–6000 psi;

vii. a tensile strength of 1000 to 15,000 psi; and viii. an elongation to break less than or equal to 500%, and the material of construction of polishing layer comprises at least one moiety from the group consisting of: 1. a urethane; 2. a carbonate; 3. an amide; 4. an ester; 5. an ether; 6. an acrylate; 7. a methacrylate; 8. an acrylic acid; 9. a methacrylic acid; 10. a sulphone; 11. an acrylamide; 12. a halide; 13. an imide; 14. a carboxyl; 15. a carbonyl; 16. an amino; 17. an aldehydric; 18. a urea; and 19. a hydroxyl.

* * * * *